US011401061B2

(12) United States Patent
Orsini et al.

(10) Patent No.: US 11,401,061 B2
(45) Date of Patent: Aug. 2, 2022

(54) FLEXIBLE PACKAGE CONVEYANCE

(71) Applicant: Sealed Air Corporation (US), Charlotte, NC (US)

(72) Inventors: Thomas Orsini, Sterling, MA (US); Mark Garceau, Bethlehem, CT (US); David Cenedella, Shirley, MA (US); Robert Simonelli, Worcester, MA (US); Michael Kalinowski, Nashua, NH (US); Kyle Brown, Frisco, TX (US); John Gilbert, Lowell, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 99 days.

(21) Appl. No.: 16/465,604

(22) PCT Filed: Nov. 14, 2017

(86) PCT No.: PCT/US2017/061432

§ 371 (c)(1),
(2) Date: May 31, 2019

(87) PCT Pub. No.: WO2018/102114

PCT Pub. Date: Jun. 7, 2018

(65) Prior Publication Data

US 2019/0382145 A1 Dec. 19, 2019

Related U.S. Application Data

(60) Provisional application No. 62/429,129, filed on Dec. 2, 2016.

(51) Int. Cl.
*B65B 9/067* (2012.01)
*B65B 31/04* (2006.01)
(Continued)

(52) U.S. Cl.
CPC ..... *B65B 9/067* (2013.01); *B65B 31/04* (2013.01); *B65B 51/10* (2013.01); *B65D 75/38* (2013.01); *B65D 2205/02* (2013.01)

(58) Field of Classification Search
CPC . B65B 9/067; B65B 31/04–043; B65B 51/10; B65D 75/38; B65D 2205/02
(Continued)

(56) References Cited

U.S. PATENT DOCUMENTS 3,237,844 A * 3/1966 Hughes ..... B65D 33/01 383/94
4,219,988 A 9/1980 King et al.
(Continued)

FOREIGN PATENT DOCUMENTS

EP 0755875 A1 1/1997
GB 2424849 A1 10/2006
(Continued)

*Primary Examiner* — Anna K Kinsaul
*Assistant Examiner* — Himchan Song
(74) *Attorney, Agent, or Firm* — Jon M. Isaacson

(57) ABSTRACT

A system for enhanced conveying of flexible packages includes a packaging system (12, 212), an inflation system (280), and a conveying system (250). The packaging system is configured to place an object in a flexible package. The inflation system is configured to insert a gas into the flexible package. The packaging system is further configured to seal an edge of the flexible package in an inflated state with the object and the inserted gas inside the flexible package. The conveying system is configured to convey the flexible package while the flexible package is substantially in the inflated state. The flexible package is configured to permit gas to escape the flexible package at a controlled flow rate such that the flexible package remains substantially in the inflated state while being conveyed by the conveying system and the
(Continued)

flexible package transitions to being substantially in a deflated state after being conveyed by the conveying system.

14 Claims, 7 Drawing Sheets

(51) Int. Cl.
*B65B 51/10* (2006.01)
*B65D 75/38* (2006.01)

(58) Field of Classification Search
USPC ..... 53/450
See application file for complete search history.

(56) References Cited

U.S. PATENT DOCUMENTS

| | | | | |
|---|---|---|---|---|
| 8,087,827 | B2 * | 1/2012 | Mir | A47J 36/027 383/102 |
| 2008/0237316 | A1 * | 10/2008 | Ogino | B65D 27/00 229/68.1 |
| 2010/0257820 | A1 * | 10/2010 | Doll | B65B 31/04 53/433 |
| 2013/0322790 | A1 * | 12/2013 | Su | B65D 77/22 383/210 |
| 2014/0123599 | A1 * | 5/2014 | Gustafsson | B65B 31/021 53/405 |
| 2018/0141686 | A1 | 5/2018 | Christman et al. | |

FOREIGN PATENT DOCUMENTS

| | | | |
|---|---|---|---|
| WO | 2015150719 | A1 | 10/2015 |
| WO | 2016179204 | A1 | 11/2016 |

* cited by examiner

FLEXIBLE PACKAGE CONVEYANCE

BACKGROUND

The present disclosure is in the technical field of preparing flexible packages for shipping. More particularly, the present disclosure is directed to inflating flexible packages for conveyance in a shipping facility.

Objects are regularly packaged and shipped in flexible packages, such as bags formed from polyethylene film. Objects can be packaged in a continuous flow of objects in a continuous flow wrap machine. Examples of such continuous flow wrap machines are described, for example, in U.S. Pat. No. 4,219,988 and are available from Sealed Air Corporation (Charlotte, N.C.) under the Shanklin FloWrap Series trademark. Once the objects are packaged in the flexible packages, the packages can be prepared for shipping, such as by adhering a shipping label to the exterior of the flexible package, and then shipped, such as by delivering the flexible package to a shipping company. The flexible packages provide a container for certain objects because they are lightweight and provide protection from being damaged or dirtied during shipment.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A method includes placing an object in a flexible package, inserting gas into the flexible package, sealing an edge of the flexible package in an inflated state with the object and the inserted gas inside the flexible package, and conveying the flexible package after sealing the edge of the flexible package in the inflated state. The flexible package includes one or more vent holes configured to permit gas to exit the flexible package. At least one characteristic of the one or more vent holes is selected to control a flow rate of gas exiting the flexible package such that the flexible package remains substantially in the inflated state during the conveying and such that the flexible package transitions to being substantially in a deflated state after the conveying is complete.

In one example, the method further includes shipping the flexible package from a shipping facility after the flexible package has transitioned to being substantially in the deflated state. In another example, the placing, the inserting, the sealing, and the conveying occur in the shipping facility. In another example, the at least one characteristic includes one or more of a size of the one or more vent holes, a shape of the one or more vent holes, a number of the one or more vent holes, a location of the one or more vent holes, or a pattern of the one or more vent holes.

In another example, the pressure inside of the flexible package is at least 1% higher than pressure outside of the flexible package when the flexible package is in the inflated state and when the flexible package is substantially in the inflated state. In another example, the pressure inside of the flexible package is in a range from 1% to 10% higher than the pressure outside of the flexible package when the flexible package is in the inflated state and when the flexible package is substantially in the inflated state. In another example, the pressure inside of the flexible package is in a range between the pressure outside of the flexible package and a pressure that is 0.2% higher than the pressure outside of the flexible package when the flexible package is substantially in the deflated state. In another example, the pressure inside of the flexible package is at least 2.5 kPa above atmospheric pressure when the flexible package is in the inflated state and when the flexible package is substantially in the inflated state. In another example, the pressure inside of the flexible package is in a range between the pressure outside of the flexible package and a pressure that is 0.5 kPa higher than the pressure outside of the flexible package when the flexible package is substantially in the deflated state. In another example, when the flexible package is in the inflated state and when the flexible package is substantially in the inflated state, a top portion of the flexible package does not contact a top portion of the object. In another example, when the flexible package is substantially in the deflated state, the top portion of the flexible package is in contact with the top portion of the object.

In another example, inserting gas into the flexible package comprises directing a flow of gas from a gas source toward an open end of the flexible package. In another example, sealing the edge of the flexible package comprises sealing the open end of the flexible package while the flow of gas is being directed toward the open end of the flexible package. In another example, the at least one characteristic of the one or more vent holes is selected to provide the flexible package with a type of functionality. In another example, the type of functionality includes at least one of aid in opening of the flexible package, prevention of damage to the flexible package, or improved ability to reuse the flexible package.

In another embodiment, a system includes a packaging system configured to place an object in a flexible package and an inflation system configured to insert a gas into the flexible package. The packaging system is further configured to seal an edge of the flexible package in an inflated state with the object and the inserted gas inside the flexible package. The system further includes a conveying system configured to convey the flexible package while the flexible package is substantially in the inflated state. The flexible package is configured to permit gas to escape the flexible package at a controlled flow rate such that the flexible package remains substantially in the inflated state while being conveyed by the conveying system and such that the flexible package transitions to being substantially in a deflated state after being conveyed by the conveying system.

In one example, the system is located in a shipping facility and the flexible package is configured to be shipped from the shipping facility when the flexible package is substantially in the deflated state. In another example, the system further includes a film dispenser configured to supply film to the packaging system, wherein the packaging system is configured to form the flexible package from the film. In another example, the film includes one or more vent holes configured to permit the gas to escape the flexible package. In another example, at least one characteristic of the one or more vent holes is selected to control the controlled flow rate of the gas out of the flexible package. In another example, the at least one characteristic includes one or more of a size of the one or more vent holes, a shape of the one or more vent holes, a number of the one or more vent holes, a location of the one or more vent holes, or a pattern of the one or more vent holes. In another example, the at least one characteristic of the one or more vent holes is selected to provide the flexible package with a type of functionality. In another example, the type of functionality includes at least one of aid in opening of the flexible package, prevention of damage to the flexible package, or improved ability to reuse the flexible package. In another example, the conveying system includes one or more of a conveyor belt or a plurality of rollers. In another example, the inflation system includes a source of pressurized gas and the source of pressurized gas includes one or more of a container of pressurized gas or a gas compressor.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of systems and methods of inflating flexible packages for conveyance in a shipping facility. In particular, in embodiments described herein, an object is placed in a flexible package and gas is inserted into a flexible package. The flexible package is sealed such that the flexible package is in an inflated state. After the flexible package is sealed, it is conveyed through the shipping facility until it is at a location where it awaits shipping out of the shipping facility. The flexible package is configured to permit gas inside of the flexible package to exit at a controlled flow rate such that the flexible package remains substantially in the inflated state while the flexible package is conveyed and then the flexible package transitions to being substantially in a deflated state after the flexible package has been conveyed.

As will be described in greater detail below, the controlled rate of gas flow out of flexible packages allows the flexible packages to be conveyed while substantially in the inflated state while then being shipped substantially in the deflated state. In some examples, conveying the flexible packages while substantially in the inflated state increases the ability of the flexible packages to be conveyed (e.g., moved on conveyors, moved on rollers, and sorted in sortation systems) without being caught in any conveyance machinery or otherwise failing during conveyance. In some examples, shipping the flexible packages while substantially in the deflated state allows for decrease shipping volumes of the flexible packages resulting in lower dimensional weight and higher packaging density, which saves on shipping costs. In addition, the embodiments described herein are able to reduce labor required to ship the flexible packages by reducing the need for human intervention to convey and sort mailers and to reduce cost of fines by shipping companies by preventing sorting errors caused by manual sortation.

Figure 1:
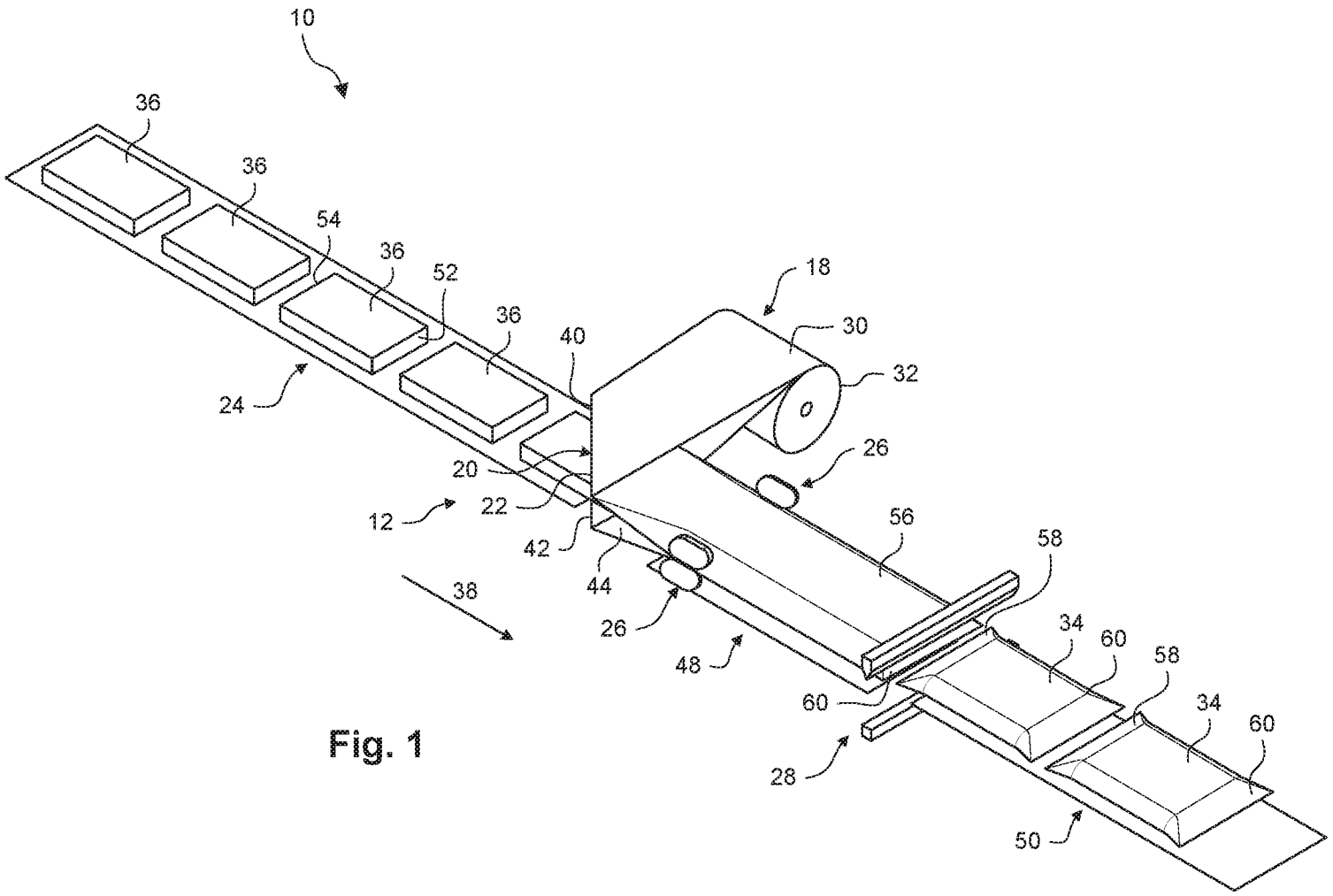
FIG. 1 depicts an embodiment of a system that includes a packaging system, in accordance with the embodiments described herein.

FIG. 1 depicts an embodiment of a system 10 that includes a packaging system 12. In the depicted embodiment, the packaging system 12 is a continuous flow wrap machine (e.g., a form-fill-seal wrapper). In other embodiments, the packaging system 12 is a non-continuous packaging system. In the depicted embodiment, the packaging system 12 includes a film dispenser 18, a transfer head 20 including an inverting head 22, an infeed conveyor 24, a longitudinal sealer 26, and an end sealer 28, as will be described in more detail herein. Examples of continuous flow wrap machines are described, for example, in U.S. Pat. No. 4,219,988, U.S. Patent Application No. 62/157,164, and PCT Application No. PCT/US2016/030630, the contents of which are incorporated herein by reference in their entirety, and are available from Sealed Air Corporation (Charlotte, N.C.) under the Shanklin FloWrap Series trademark.

The film dispenser 18 of the continuous flow wrap machine supplies a web of film 30 from roll 32. Systems for supplying webs of film are known in art and may include unwind mechanisms and other features. In some embodiments, the film 30 on the roll 32 is a center folded film. In other embodiments, the film 30 on roll 32 is a flat wound film. In some embodiments, the film 30 includes any sheet or film material suitable for packaging objects 36, in particular for flexible packages 34 for use as a mailer containing an object. Suitable materials include polymers, for example thermoplastic polymers (e.g., polyethylene), that are suitable for heat sealing. In some embodiments, the film 30 has a thickness of any of at least 2, 3, 5, 7, 10, and 15 mils; and/or at most any of 25, 20, 16, 12, 10, 8, 6 and 5 mils. In some embodiments, the film 30 is multilayered, and has an outer layer adapted for heat sealing the film to itself to form a seal.

The transfer head 20 of the packaging system 10 receives the web of film 30 from the film dispenser 18. The transfer head 20 is adapted to manage (e.g., form) the web of film 30 into a configuration for eventual sealing into a tube. In the depicted embodiment, the transfer head 20 is an inverting head 22 of continuous flow wrap that receives a center folded web of film 30 from the film dispenser 18 and redirects the web of film over the top and bottom inverting head arms 40, 42 to travel in a conveyance direction 38 by turning the web of film inside out. In this manner, the transfer head 20 is adapted to manage the web of film 30 to provide an interior space 44 bounded by the film 30.

In some embodiments, the transfer head 20 in the configuration of a forming box receives the lay flat web of film 30 from the film dispenser 18 and redirects the web of film over the forming head to travel in the conveyance direction 38 by turning the web of film inside out. In this manner, the transfer head 20 is adapted to manage the web of film 30 to provide an interior space 44 bounded by film 30.

The infeed conveyor 24 of packaging system 12 is adapted to transport a series of objects 36 and sequentially deliver them in the conveyance direction 38. In some embodiments, the infeed conveyor is adapted to convey a series of objects 36. In the embodiment depicted in FIG. 1, the objects 36 have a similar size. In other embodiments, the objects have varied or differing sizes. Within the series of objects 36 in sequential order, a "preceding" object is upstream from a "following" object. The infeed conveyor 24 is configured to deliver in repeating fashion a preceding object upstream from a following object into the interior space 44 of the web of film 30. In some embodiments, the objects 36 are delivered in spaced or gapped arrangement from each other.

An "object," as used herein, may comprise a single item for packaging, or may comprise a grouping of several distinct items where the grouping is to be in a single package. Further, an object may include an accompanying informational item, such as a packing slip, tracking code, a manifest, an invoice, or printed sheet comprising machine-readable information (e.g., a bar code) for sensing by an object reader (e.g., a bar code scanner).

Downstream from the infeed conveyor 24 is an object conveyor 48, which is adapted to support and transport the web of film 30 and the object 36 downstream together to the end sealer 28. A discharge conveyor 50 transports the series of packages 34 from the end sealer 28.

As each object 36 of the series of objects sequentially travels through the packaging system 12, its position within the machine is tracked. This is accomplished by ways known in the art. For example, an infeed eye system (horizontal or vertical) determines the location of the front edge 52 of each object and the location of the rear edge 54 of each object as the object travels along the conveyor. This location information is communicated to a controller (i.e., a programmable logic controller or "PLC"). A system of encoders and counters, also in communication with the PLC, determines the amount of travel of the conveyor on which the object is positioned. In this manner, the position of the object 36 itself is determined and known by the PLC. The PLC is also in communication with the end sealer 28 to provide the object position information for a particular object to these unit operations.

In the depicted embodiment, the packaging system 12 includes longitudinal sealers 26 adapted to continuously seal sides of the film 30 together to form a tube 56 enveloping one of the objects 36. In the depicted embodiment, the longitudinal sealers 26 are located at sides of the tube 56, where each of the longitudinal sealers 26 forms a side seal between two edge portions of the film 30. In other embodiments, a The longitudinal sealer 26 may be located beneath the tube 56, where the sealer may form, for example, a center fin seal between two edge portions of the web of film 30. As two edge portion of film 30 are brought together at the longitudinal sealer 26 to form the tube 56, they are sealed together, for example, by a combination of heat and pressure, to form a continuous fin or a side seal. Appropriate longitudinal sealers are known in the art, and include, for example, heat sealers.

The packaging system 12 includes end sealer 28, which is adapted to provide or perform in repeating fashion, while the tube 56 is traveling: (i) a trailing edge seal 58 that is transverse to tube 56 and upstream from a preceding object to create flexible package 34 and (ii) a leading edge seal 60 transverse to the tube 56 and downstream from a following object. Further, the end sealer 28 is adapted to sever the flexible package 34 from the tube 56 by cutting between the trailing edge seal 58 and the leading edge seal 60. Generally, the end sealer 28 uses temperature and pressure to make two seals (trailing edge seal 58 and leading edge seal 60) and cuts between them, thus creating the final, trailing seal of one finished, preceding package and the first, leading edge seal of the following package. Advantageously, the end sealer unit may be adapted to simultaneously sever the flexible package 34 from the tube 56 while providing the trailing edge seal 58 and leading edge seal 60.

Useful end sealer units are known in the art. These include, for example, rotary type of end sealer units, having matched heated bars mounted on rotating shafts. As the film tube passes through the rotary type, the rotation is timed so it coincides with the gap between objects. A double seal is produced and the gap between the two seals is cut by an integral blade to separate individual packs. Another type of end seal unit is the box motion type, having a motion that describes a "box" shape so that its horizontal movement increases the contact time between the seal bars and the film. Still another type of end sealer unit is the continuous type, which includes a sealing bar that moves down with the tube while sealing.

While the system 10 depicted in FIG. 1 is capable of packaging objects 36 in flexible packages 34 that are suitable for shipping, the flexible packages 34 are susceptible to failure during conveyance. Depicted in FIGS. 2A to 2C are examples of possible failures of the flexible packages 34 during conveyance.

Figure 2C:
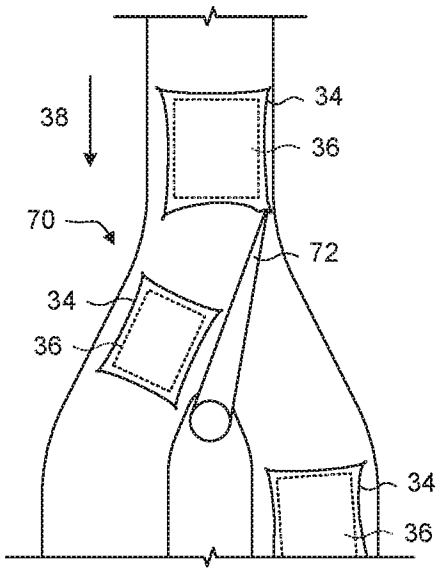
FIGS. 2A to 2C depict examples of possible failures of the flexible packages during conveyance, in accordance with the embodiments described herein.
Figure 2A:
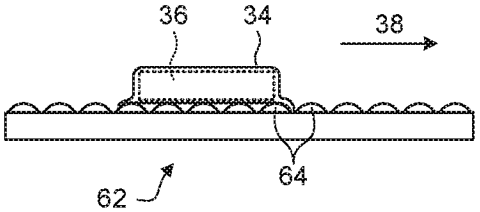

In FIG. 2A, a side view of a roller system 62 is depicted. A flexible package 34 with an object 36 inside is conveyed by the roller system 62 in the conveyance direction 38 over a number of rollers 64. As shown in FIG. 2A, a loose portion of the flexible package 34 is able to slip between two of the rollers 64. This loose portion of the flexible package 34 may jam the flexible package 34 in the rollers 64, preventing the flexible package 34, and possibly other flexible packages 34, from moving further in the conveyance direction 38 until a person manually clears the jam.

Figure 2B:
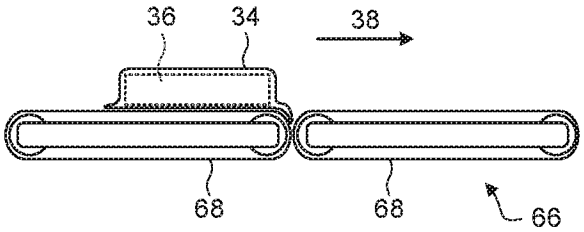

In FIG. 2B, a side view of a conveyor belt system 66 is depicted. A flexible package 34 with an object 36 inside is conveyed by the conveyor belt system 66 in the conveyance direction 38 over two conveyor belts 68. As shown in FIG. 2B, a loose portion of the flexible package 34 is able to slip between the two conveyor belts 68. This loose portion of the flexible package 34 may jam the flexible package 34 in the conveyor belts 68, preventing the flexible package 34, and possibly other flexible packages 34, from moving further in the conveyance direction 38 until a person manually clears the jam.

In FIG. 2C, a top view of a sortation system 70 is depicted. The sortation system 70 includes a gate 72 that directs flexible packages 34 from an upstream chute into one of two downstream chutes in the conveyance direction 38. As shown in FIG. 2C, a loose portion of the flexible package 34 is caught in the gate 72. This loose portion of the flexible package 34 may jam the flexible package 34 in the chute, preventing the flexible package 34 and other upstream flexible packages, from moving further in the conveyance direction 38 until a person manually clears the jam.

Figure 3:
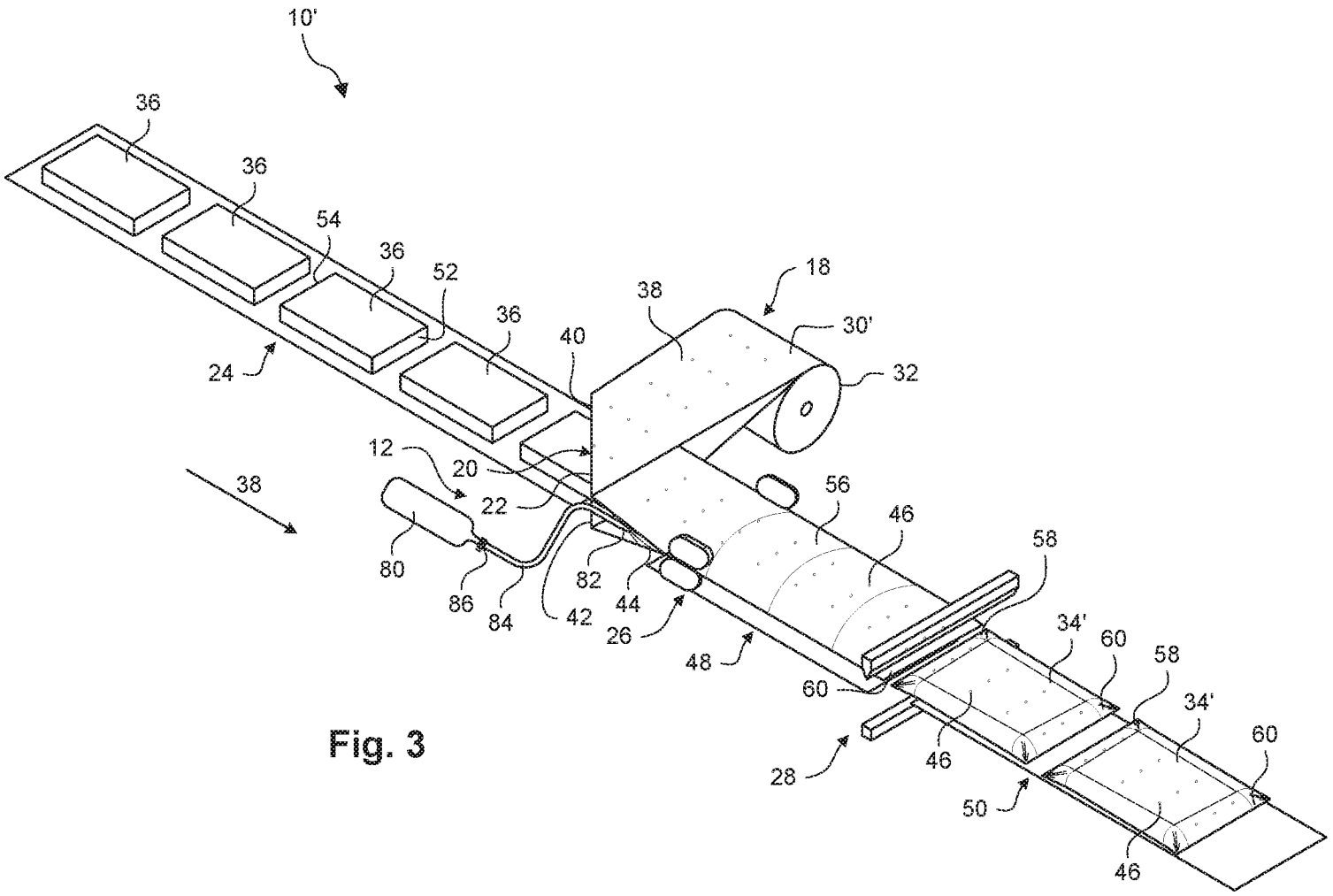
FIG. 3 depicts an embodiment of a system that is a variation of the system depicted in FIG. 1, in accordance with the embodiments described herein.

Depicted in FIG. 3 is an embodiment of a system 10' that is a variation of the system 10 depicted in FIG. 1. The system 10' is different from the system 10 in a number of ways. In one example, the film dispenser 18 includes a web of film 30' that has vent holes 46. Thus, the flexible packages 34' created by the system 10' also have vent holes 46. In some embodiments, at least one characteristic of the vent holes 46—such as a size of the vent holes 46, a shape of the vent holes 46, a number of the vent holes 46, a location of the vent holes 46, or a pattern of the vent holes 46—is selected to control a flow rate of gas exiting the flexible packages 34'.

In another example, the system 10' includes a source of pressurized gas 80. In the depicted embodiment, the source of pressurized gas 80 is a container (e.g., a cylinder) of pressurized gas. In other embodiments, the source of pressurized gas 80 is a gas compressor or any other machine or container configured to provide pressurized gas. The source of pressurized gas 80 is in fluid communication with a nozzle 82 configured to insert gas in the flexible packages 34'. In the depicted embodiment, the nozzle 82 is configured to direct gas through the interior space 44 and the tube 56 so that the flexible packages 34' are in an inflated state when the end sealer 28 seals the trailing edge of the flexible packages 34'. In some embodiments, the flexible packages 34' are configured to reaming substantially in the inflated state while they are conveyed on discharge conveyor 50 and any subsequent conveyors. In the depicted embodiment, the source of pressurized gas 80 is coupled to the nozzle via piping 84. The piping 84 may include rigid piping (e.g., copper piping) or flexible piping (e.g., rubber tubing). In the depicted embodiment, a valve 86 is located between the source of pressurized gas 80 and the nozzle 82. In some examples, the valve 86 is controlled by a computing device or other manual, semi-automatic or automatic means so that a particular amount of gas is inserted into the flexible packages 34' to place the flexible packages 34' in the inflated state.

Figure 4A:
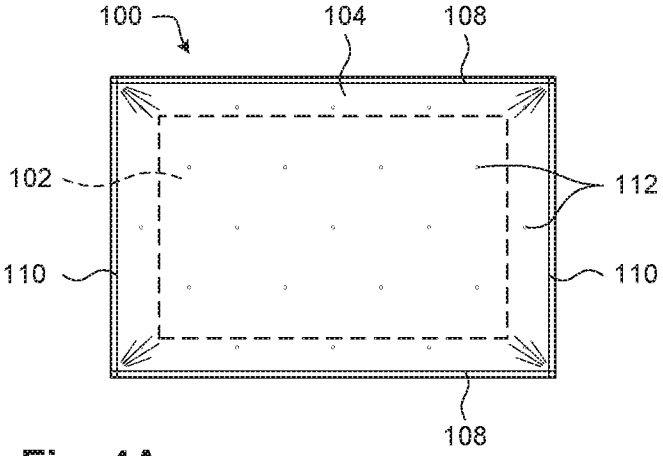
FIGS. 4A, 4B, and 4C depict, respectively, top, side, and end cross-sectional views of a flexible package in an inflated state, in accordance with the embodiments described herein.
Figure 4B:
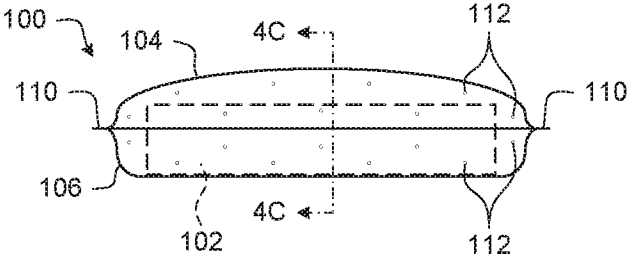
Figure 4C:
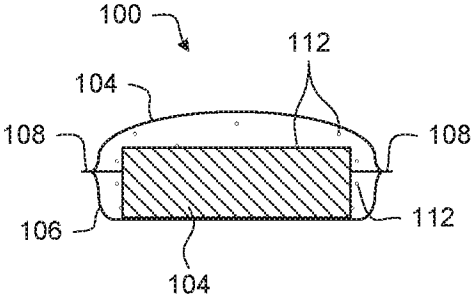

FIGS. 4A, 4B, and 4C depict, respectively, top, side, and end cross-sectional views of a flexible package 100 in an inflated state. The flexible package 100 encloses an object 102. While the object 102 depicted in FIGS. 4A to 4C has a rectangular prism shape, the flexible package 100 may enclose objects of any shape. The flexible package 100 is made from a first film 104 and a second film 106. The first film 104 and the second film 106 are sealed to each other along side seals 108 and along end seals 110. Both the first film 104 and the second film 106 include vent holes 112 that permit gas to exit the flexible package 100. In some embodiments, the flow rate of gas out of the flexible package 100 is controlled by selecting one or more of a size of the vent holes 112, a shape of the vent holes 112, a number of the vent holes 112, a location of the vent holes 112, or a pattern of the vent holes 112.

The flexible package 100 may be in the inflated state, as shown in FIGS. 4A to 4C, when the edges are sealed. However, because the vent holes 112 permit gas to exit the flexible package 100, the flexible package 100 does not remain in the inflated state. In some embodiments, one or more characteristics of the vent holes 112 are selected so that the flexible package 100 remains in the inflated state or substantially in the inflated state while the flexible package is conveyed within the shipping facility. In some embodiments, the pressure inside of the flexible package 100 is at least 1% higher than the pressure outside of the flexible package 100 when the flexible package is in the inflated state and when the flexible package is substantially in the inflated state. For example, the pressure inside of the flexible package 100 can be in a range from 1% to 10% higher than the pressure outside of the flexible package 100 when the flexible package is in the inflated state and when the flexible package is substantially in the inflated state. In some embodiments, the pressure inside of the flexible package 100 is at least 2.5 kPa above atmospheric pressure when the flexible package 100 is in the inflated state and when the flexible package is substantially in the inflated state. In some embodiments, when the flexible package 100 is in the inflated state and when the flexible package is substantially in the inflated state, a top portion of the flexible package 100 does not contact a top portion of the object 102, as can be seen in FIGS. 4A to 4C.

Figure 5A:
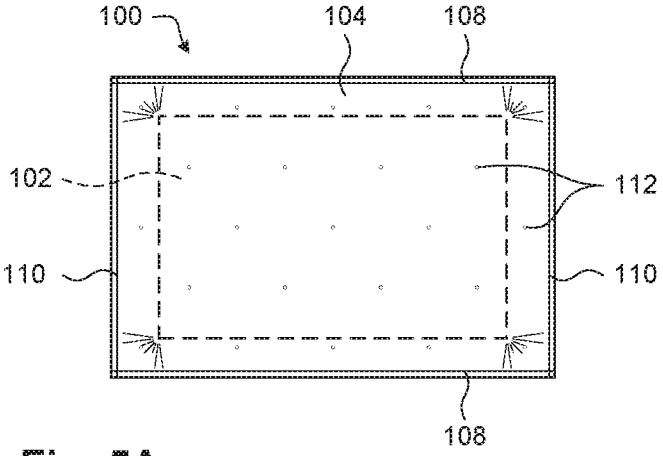
FIGS. 5A, 5B, and 5C depict, respectively, top, side, and end cross-sectional views of the flexible package shown in FIGS. 4A to 4C in substantially in a deflated state, in accordance with the embodiments described herein.
Figure 5B:
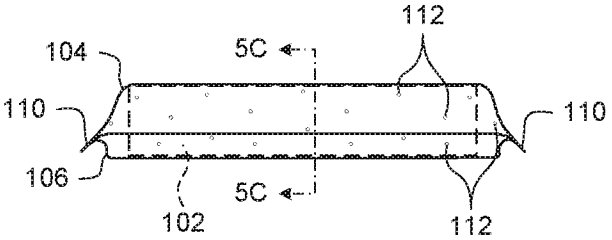
Figure 5C:
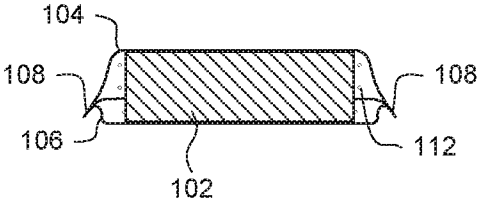

After the flexible package 100 has been conveyed, the vent holes 112 continues to permit gas to exit the flexible package 100 until the flexible package 100 transitions to being substantially in a deflated state. Depicted in FIGS. 5A, 5B, and 5C are, respectively, top, side, and end cross-sectional views of the flexible package 100 substantially in a deflated state. In some embodiments, the pressure inside of the flexible package 100 is in a range between the pressure outside of the flexible package 100 and a pressure that is 0.2% higher than the pressure outside of the flexible package 100 when the flexible package 100 is substantially in the deflated state. In some embodiments, the pressure inside of the flexible package 100 is in a range between the pressure outside of the flexible package 100 and a pressure that is 0.5 kPa higher than the pressure outside of the flexible package 100 when the flexible package 100 is substantially in the deflated state. In some embodiments, when the flexible package 100 is substantially in the deflated state, the top portion of the flexible package 100 is in contact with the top portion of the object 102.

After the flexible package 100 has transitioned to being substantially in the deflated state, the flexible package 100 may continue to deflate as gas continues to exit the flexible package 100 via the vent holes 112. In some embodiments, the object 102 is enclosed in the flexible package 100 and conveyed in a shipping facility (e.g., a warehouse). After the flexible package 100 is conveyed while substantially in the inflated state, the flexible package 100 transitions to being substantially in the deflated state while still in the shipping facility. At that point, the flexible package 100 is ready to be shipped with lower dimensional weight and higher packaging density, which saves on shipping costs.

Figure 6:
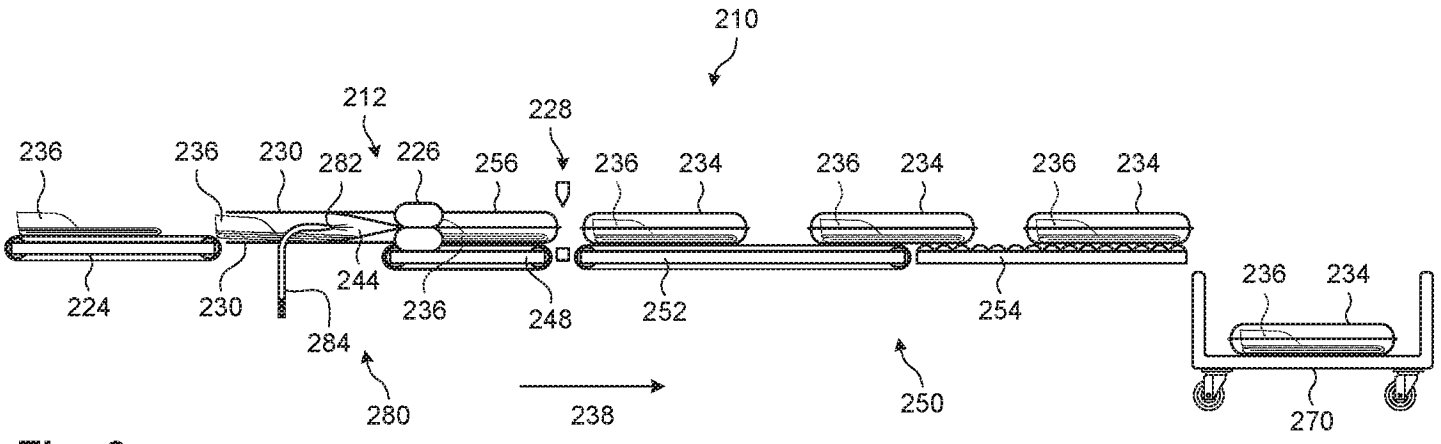
FIG. 6 depicts an embodiment of a system that includes a packaging system, an inflation system, and a conveying system, in accordance with the embodiments described herein.

FIG. 6 depicts an embodiment of a system 210 that includes a packaging system 212. In the depicted embodiment, the packaging system 212 is a continuous flow wrap machine (e.g., a form-fill-seal wrapper) or a non-continuous packaging system. A web of film 230 is supplied to form flexible packages 234 around objects 236. In some embodiments, the film 230 includes any sheet or film material suitable for packaging objects 236, in particular for flexible packages 234 for use as a mailer. Suitable materials include polymers, for example thermoplastic polymers (e.g., polyethylene), that are suitable for heat sealing. In some embodiments, the film 230 is multilayered, and has an outer layer adapted for heat sealing the film to itself to form a seal.

An infeed conveyor 224 of the packaging system 212 is adapted to transport a series of the objects 236 and sequentially deliver them in a conveyance direction 238. In some embodiments, the infeed conveyor 224 is adapted to convey a series of the objects 236. In the embodiment depicted in FIG. 6, the objects 236 are folded shirts that have a similar size. In other embodiments, the objects have varied or differing sizes. Within the series of objects 236 in sequential order, a "preceding" object is upstream from a "following" object. The infeed conveyor 224 is configured to deliver in repeating fashion a preceding object upstream from a following object into an interior space 244 of the web of film 230.

Downstream from the infeed conveyor 224 is an object conveyor 248, which is adapted to support and transport the web of film 230 and the object 236 downstream together to the end sealer 228. A conveying system 250 transports the series of the flexible packages 234 from the end sealer 228 to a cart 270. In the depicted embodiment, the conveying system 250 includes a conveyor belt 252 and a set of rollers 254. In other embodiments, the conveying system 250 after the end sealer 228 may include any number of conveyor belts, rollers, chutes, sortation systems, other forms of conveyance, or any combination thereof.

In the depicted embodiment, the packaging system 212 includes longitudinal sealers 226 adapted to continuously seal sides of the film 230 together to form a tube 256 enveloping one of the objects 236. In the depicted embodiment, the longitudinal sealers 226 are located at sides of the tube 256, where each of the longitudinal sealers 226 forms a side seal between two edge portions of the film 230. As two edge portion of film 230 are brought together at the longitudinal sealer 226 to form the tube 256, they are sealed together, for example, by a combination of heat and pressure, to form a continuous fin or a side seal. Appropriate longitudinal sealers are known in the art, and include, for example, heat sealers.

The packaging system 212 includes an end sealer 228, which is adapted to provide or perform in repeating fashion, while the tube 256 is traveling: (i) a trailing edge seal that is transverse to tube 256 and upstream from a preceding object to create the flexible packages 234 and (ii) a leading edge seal transverse to the tube 256 and downstream from a following object. Further, the end sealer 228 is adapted to sever the flexible packages 234 from the tube 256 by cutting between the trailing edge seal and the leading edge seal. Generally, the end sealer 228 uses temperature and pressure to make two seals (trailing edge seal and leading edge seal) and cuts between them, thus creating the final, trailing seal of one finished, preceding package and the first, leading edge seal of the following package. Advantageously, the end sealer unit may be adapted to simultaneously sever the flexible packages 234 from the tube 256 while providing the trailing and leading edge seals.

The packaging system 212 includes an inflation system 280. The inflation system 280 includes a nozzle 282 configured to insert gas into the flexible packages 234. In the depicted embodiment, the nozzle 282 is configured to direct gas through the interior space 244 and the tube 256 so that the flexible packages 234 are in an inflated state when the end sealer 228 seals the trailing edge of the flexible packages 234. The inflation system 280 also includes a source of pressurized gas (not shown) that is in fluid communication with the nozzle 282 via piping 284. In some embodiments, the source of pressurized gas is a container (e.g., a cylinder) of pressurized gas, a gas compressor, or any other machine or container configured to provide pressurized gas.

Conveying the flexible packages 234 while the flexible packages are substantially in an inflated state decreases the possibility of the flexible packages 234 failing during conveyance by the conveying system 250. In one particular example shown in FIG. 6, one of the flexible packages 234 that is substantially in the inflated state is able to be transferred from the conveyor belt 252 to the set of rollers 254 without being caught or jammed during the transfer. The flexible packages 234 that are in the inflated state or substantially in the inflated state form "pillows" that are more rigid than flexible packages in the deflated stated. This increased rigidity reduces the possibility of the flexible packages 234 failing during conveyance.

Figure 7:
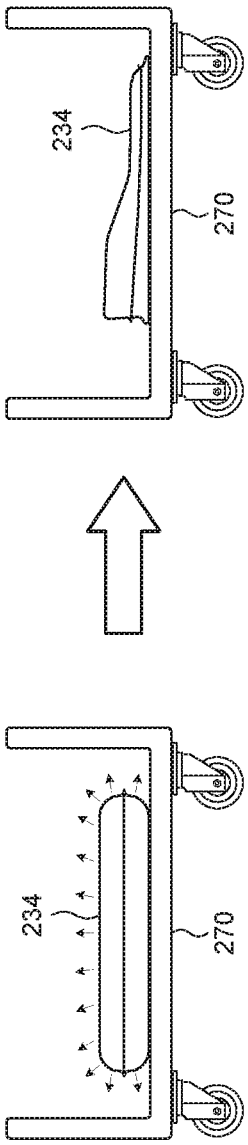
FIG. 7 depicts an example of gas exiting a flexible package exiting until the flexible package is substantially in a deflated state, in accordance with the embodiments described herein.

After conveyance, the gas in the flexible packages 234 continues to exit until the flexible packages are substantially in a deflated state. One example of this continued deflation is depicted in FIG. 7. On the left side of FIG. 7, the flexible package 234 is located in the cart 270 after having been conveyed on the conveying system 250. In this state, the flexible package 234 is substantially in the inflated state. As shown by the arrows, gas exits the flexible package 234, such as by exiting through vent holes in the flexible package 234. The gas continues to exit the flexible package 234 until the flexible package 234 is substantially in the deflated state, as shown on the right side of FIG. 7. While the flexible package 234 is located in the cart 270 during deflation in the embodiment shown in FIG. 7, the flexible package 234 may be located in any other location during deflation. In some examples, the flexible package 234 may be located on a shelf, in a bin, on the end of the conveyance system, or in any other location during deflation.

As noted above, a flow rate of gas out of flexible packages may be controlled by one or more characteristics of vent holes in the flexible package. In some embodiments, the one or more characteristics include one or more of a size of the vent holes, a shape of the vent holes, a number of the vent holes, a location of the vent holes, or a pattern of the vent holes. Depicted in FIGS. 8A to 8D are embodiments of films having vent holes with different characteristics.

Figure 8B:
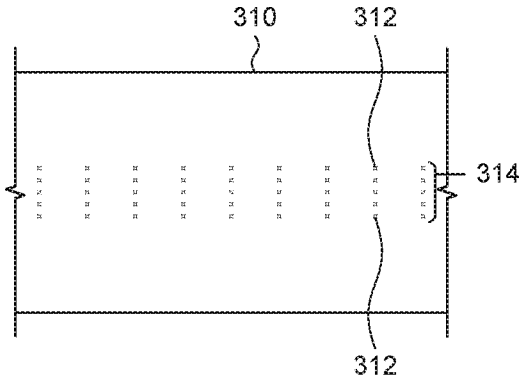
FIGS. 8A to 8D depict embodiments of films having vent holes with different characteristics, in accordance with the embodiments described herein.
Figure 8D:
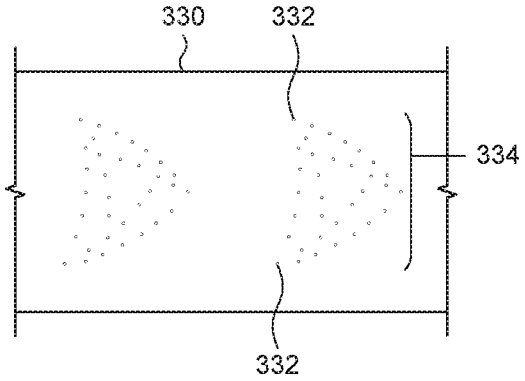
Figure 8A:
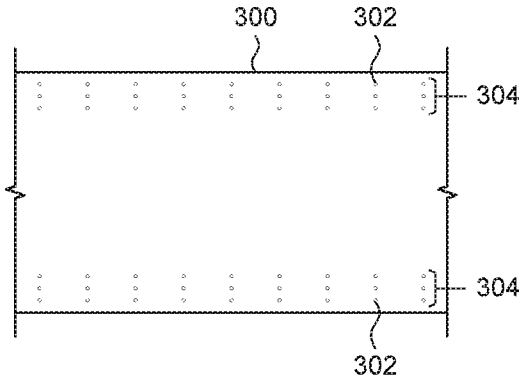

In FIG. 8A, a film 300 includes vent holes 302 that are circular in shape. The vent holes 302 are arranged as rows 304 of three vent holes 302 periodically spaced along the length of the film 300. The rows 304 of the vent holes 302 are located near the sides of the film 300. In FIG. 8B, a film 310 includes vent holes 312 that are x-shaped. The shape of the vent holes 312 may provide for a different flow rate of gas through the vent holes 312 than flows through the circular vent holes 302. The vent holes 312 are arranged as a single row 314 of five vent holes 312 periodically spaced along the length of the film 310. Placing the row 314 of vent holes 312 near the center of the film 310 may provide a different flow rate of gas through the vent holes 312 than flows through the circular vent holes 302 that are located near the sides of the film 300.

Figure 8C:
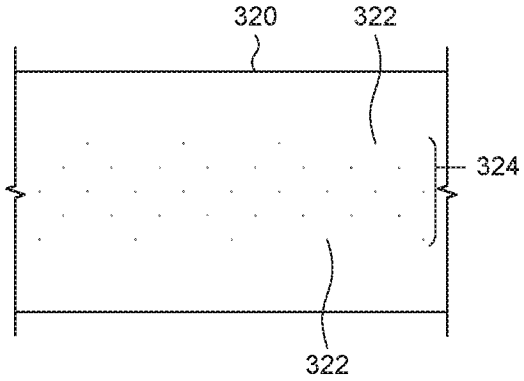

In FIG. 8C, a film 320 includes vent holes 322 that area circular in shape. Each of the vent holes 322 is smaller in diameter than the vent holes 302 depicted in FIG. 8A, which may provide a reduced flow rate through each of the vent holes 322 than flows through each of the vent holes 302. The vent holes 322 are also arranged in a pattern 324 located near the center of the film 320. The pattern 324 itself may be selected based on a desired flow rate of gas through the vent holes 322 or the pattern 324 may be selected based on a desired aesthetic look of the film 320.

In FIG. 8D, a film 330 includes vent holes 332 that area circular in shape. Each of the vent holes 332 is larger in diameter than the vent holes 322 depicted in FIG. 8C, which may provide an increased flow rate through each of the vent holes 332 than flows through each of the vent holes 322. The vent holes 332 are also arranged in a pattern 334 located near the center of the film 330. The pattern 334 is in the shape of a logo or other picture, which may be selected based on a desired aesthetic look or selected to provide an advertising feature, such as in the case where the pattern 334 is a logo or trademark associated with a company.

While the sizes, shapes, number, patterns, and locations of vent holes depicted in FIGS. 8A to 8D show specific embodiments of vent hole characteristics, it should be noted that vent holes can be in any other size, shape, number, pattern, and location. Because vent hole characteristics affect flow rates of gas through the vent holes, the characteristics of vent holes may be selected such that a flexible package that includes the vent holes remains substantially in an inflated state during conveyance in a shipping facility before transitioning to substantially to a deflated state.

In some embodiments, one or more vent hole characteristics (e.g., size, shape, number, pattern, and/or location) in film may be selected to provide functionality to a flexible package formed from the film. In one example, one or more vent hole characteristics are selected such that vent holes are arranged in the film to aid in the propagated, controlled opening of the flexible package (e.g., by a recipient of the flexible package). In another example, one or more vent hole characteristics are selected such that vent holes are arranged in the film to prevent damage to the flexible package. In another example, one or more vent hole characteristics are selected such that vent holes are arranged in the film to and allow the flexible package to be reused (e.g., reused by a recipient of the flexible package). In other examples, one or more vent hole characteristics are selected such that vent holes are arranged in the film to provide the flexible package with any other type of functionality.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A method comprising:

placing an object in a flexible package;

inserting gas into the flexible package from a source of pressurized gas;

sealing an edge of the flexible package in an inflated state with the object and the inserted gas inside the flexible package; and conveying the flexible package after sealing the edge of the flexible package in the inflated state; and wherein the flexible package includes one or more vent holes configured to permit gas to exit the flexible package; and wherein at least one characteristic of the one or more vent holes is selected to control a flow rate of gas exiting the flexible package such that the flexible package remains substantially in the inflated state during the conveying and such that the flexible package transitions to being substantially in a deflated state after the conveying is complete.

2. The method of claim 1, further comprising:

shipping the flexible package from a shipping facility after the flexible package has transitioned to being substantially in the deflated state.

3. The method of claim 2, wherein the placing, the inserting, the sealing, and the conveying occur in the shipping facility.

4. The method of claim 1, wherein the at least one characteristic includes one or more of a size of the one or more vent holes, a shape of the one or more vent holes, a number of the one or more vent holes, a location of the one or more vent holes, or a pattern of the one or more vent holes.

5. The method of claim 1, wherein the pressure inside of the flexible package is at least 1% higher than pressure outside of the flexible package when the flexible package is in the inflated state and when the flexible package is substantially in the inflated state.

6. The method of claim 5, wherein the pressure inside of the flexible package is in a range from 1% to 10% higher than the pressure outside of the flexible package when the flexible package is in the inflated state and when the flexible package is substantially in the inflated state.

7. The method of claim 5, wherein the pressure inside of the flexible package is in a range between the pressure outside of the flexible package and a pressure that is 0.2% higher than the pressure outside of the flexible package when the flexible package is substantially in the deflated state.

8. The method of claim 1, wherein the pressure inside of the flexible package is at least 2.5 kPa above atmospheric pressure when the flexible package is in the inflated state and when the flexible package is substantially in the inflated state.

9. The method of claim 8, wherein the pressure inside of the flexible package is in a range between the pressure outside of the flexible package and a pressure that is 0.5 kPa higher than the pressure outside of the flexible package when the flexible package is substantially in the deflated state.

10. The method of claim 1, wherein, when the flexible package is in the inflated state and when the flexible package is substantially in the inflated state, a top portion of the flexible package does not contact a top portion of the object.

11. The method of claim 10, wherein, when the flexible package is substantially in the deflated state, the top portion of the flexible package is in contact with the top portion of the object.

12. The method of claim 1, wherein inserting gas into the flexible package comprises directing a flow of gas from a gas source toward an open end of the flexible package.

13. The method of claim 12, wherein sealing the edge of the flexible package comprises sealing the open end of the flexible package while the flow of gas is being directed toward the open end of the flexible package.

14. The method of claim 1, wherein the at least one characteristic of the one or more vent holes is selected to provide the flexible package with a type of functionality, and wherein the type of functionality includes at least one of aid in opening of the flexible package, prevention of damage to the flexible package, or improved ability to reuse the flexible package.

* * * * *